US006901995B2

(12) United States Patent
Yamaguchi et al.

(10) Patent No.: US 6,901,995 B2
(45) Date of Patent: Jun. 7, 2005

(54) HEAT EXCHANGERS AND FIN FOR HEAT EXCHANGERS AND METHODS FOR MANUFACTURING THE SAME

(75) Inventors: Toru Yamaguchi, Isesaki (JP); Kazuki Hosoya, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/779,478

(22) Filed: Feb. 9, 2001

(65) Prior Publication Data

US 2001/0011586 A1 Aug. 9, 2001

(30) Foreign Application Priority Data

Feb. 9, 2000 (JP) ..... P2000-31349

(51) Int. Cl.[7] ..... F28D 1/053; F28F 13/12; F28F 9/24

(52) U.S. Cl. ..... 165/152; 165/109.1; 165/153; 165/173; 165/177

(58) Field of Search ..... 165/109.1, 177, 165/185, 152, 153, 173; 257/722

(56) References Cited

U.S. PATENT DOCUMENTS 2,360,123 A * 10/1944 Gerstung et al. ..... 165/109.1
3,768,149 A * 10/1973 Swaney, Jr. ..... 165/166
5,088,193 A 2/1992 Okada et al.
5,099,576 A 3/1992 Shinmura
5,172,762 A 12/1992 Shinmura et al.
5,214,847 A 6/1993 Aoki
5,318,114 A 6/1994 Sasaki
5,625,229 A * 4/1997 Kojima et al. ..... 257/722
5,632,331 A 5/1997 Shinmura
5,675,474 A * 10/1997 Nagase et al. ..... 165/185
5,894,886 A 4/1999 Chiba et al.

FOREIGN PATENT DOCUMENTS

JP 07280484 10/1995

* cited by examiner

*Primary Examiner*—Leonard R. Leo
(74) *Attorney, Agent, or Firm*—Baker Botts L.L.P.

(57) ABSTRACT

A method for manufacturing a fin for a heat exchanger includes the steps of forming an intermediate pre-formed plate, which has adjacent zigzag strips, by passing a flat plate material between a pair of first processing rollers, and forming a fin by passing the intermediate pre-formed plate between a pair of second processing rollers to bend the zigzag strips at a portion connecting adjacent zigzag strips. The fin includes a plurality of waving strips arranged adjacent to each other in the transverse direction, which are offset in the longitudinal direction. The adjacent waving strips are connected only between the flat portions of the waving strips at a connection length less than or equal to a plate thickness. The fin may be manufactured readily and inexpensively. A heat exchanger using the fin as an inner or outer fin may exhibit superior performance.

10 Claims, 6 Drawing Sheets

HEAT EXCHANGERS AND FIN FOR HEAT EXCHANGERS AND METHODS FOR MANUFACTURING THE SAME

BACKGROUND OF THE INVENTION

1. Field of the Invention

The present invention relates to heat exchangers and fins for heat exchangers and methods for manufacturing the fins. More specifically, the invention relates to methods for easily processing fins for heat exchangers, in a form having an excellent brazing ability, and fins manufactured by these methods, and heat exchangers using such fins. Such fins may improve the performance of the heat exchangers by increasing the efficiency of heat transfer.

2. Description of Related Art

In a heat exchanger, it is known that the performance of the heat exchanger may be improved by increasing the efficiency of heat transfer by providing a fin. For example, there are methods for proving inner fins in heat transfer tubes, and methods for providing fins at positions outside of the heat transfer tubes. For instance, an outer fin may be provided at a position between adjacent tubes.

In an inner fin provided in a heat transfer tube for a heat exchanger, a fin configuration is known, in which a fin divides the inside of the tube into a plurality of small flow paths extending in the longitudinal direction of the tube.

In a heat exchanger having an inner fin with such small flow paths, and in which the heat transfer medium flowing in the heat transfer tubes is refrigerant, a differential between the temperature of refrigerant flowing in a small flow path formed at an air entrance side of the tube in the transverse direction of the tube and the temperature of air flowing outside the air entrance side of the tube, is greater than a differential between a temperature of refrigerant flowing in a small flow path formed at an air exit side of the tube in the transverse direction of the tube and a temperature of air flowing outside the air exit side of the tube. Therefore, the heat transfer performance at the air entrance side of the tube is generally better than the heat transfer performance at the air exit side of the tube. Consequently, the liquefaction and condensation of the refrigerant flowing in the small flow path located at the air entrance side of the tube is greatly accelerated. Moreover, the ratio of the liquid component of the refrigerant relative to the gaseous component increases, the specific gravity of the refrigerant also increases, and its flow velocity decreases. On the other hand, the liquefaction and condensation of the refrigerant flowing in the small flow path located at the air exit side of the tube is less accelerated. The ratio of the gaseous component of the refrigerant relative to the liquid component increases, the specific gravity of the refrigerant decreases, and its flow velocity increases. Thus, in a single heat transfer tube, a difference of heat transfer performance occurs in its transverse direction, namely, in the air flow direction, and the overall efficiency of heat transfer of the heat exchanger may be greatly reduced.

For such a problem, a method is known for forming an inner fin in such a form that the heat transfer medium flowing in a heat transfer tube may repeatedly diverge and rejoin. For example, Japanese Patent Publication No. JP-A-7-280484 (JP' 484) discloses an inner fin wherein a plurality of waving strips are arranged adjacent to each other in the transverse direction, and the adjacent waving strips are offset to each other in the longitudinal direction. As depicted in FIG. 13, in inner fin 101 disclosed in JP' 484, waving strips 102 and 103 are adjacent to each other and are connected between adjacent raised portions and between adjacent depressed portions at a connection length. Connection length is about L/2, which is about one-half of the length of one raised portion and about one-half of the length of one depressed portion. The connected portions are repeatedly formed in the longitudinal direction of inner fin 101.

In the inner fin having such a structure, because flow paths for repeating the diverging and rejoining of the flow of the heat transfer medium are formed between adjacent waving strips over the entire area in the plane direction of the inner fin, the temperature in the heat transfer tube inserted with the inner fin is made more uniform, and the overall efficiency of heat transfer of the tube may increase. Moreover, because the adjacent raised portions and the adjacent depressed portions are successively connected to each other, a brazing material may flow along the connected portions, and the brazing ability of the inner fin to the heat transfer tube may increase.

In the fin structure disclosed in JP' 484, however, because the adjacent raised portions and the adjacent depressed portions of adjacent waving portions 102 and 103 are connected over a relatively long region (i.e., over a length of about one-half of a raised portion or depressed portion), the respective waving strips may only be formed by pressing, and a rolling process capable of continuously processing to bend a material basically may not be applied to form the connected waving strips. If the connected waving strips were formed by a rolling process, the connected portions between the adjacent raised portions and the adjacent depressed portions would be pulled in the direction, in which the waving strips extend, and the waving strips would be deformed.

Further, because pressing is generally performed discretely at each unit area corresponding to a size of a press die, its productivity is much poorer when compared with that of a rolling process, in which the processing is continuously performed while rollers are rotated. Moreover, the press dies are expensive to produce.

SUMMARY OF THE INVENTION

Accordingly, a need has arisen to provide a method for manufacturing a fin for a heat exchanger, which fin is formed by a plurality of waving strips arranged adjacent to each other and which method may achieve a superior coefficient of heat transfer, readily and inexpensively by a rolling process. Further, a need has arisen for a fin manufactured by this method, and a heat exchanger using such fins.

To meet the foregoing and other needs, a fin for a heat exchanger according to the present invention is herein disclosed. The fin for a heat exchanger comprises a plurality of waving strips, each having a repeated structure comprising a first flat portion, a first inclined plate portion extending from the first flat portion at a first inclination angle, a second flat portion extending from the first inclined plate portion in parallel to the first flat portion, and a second inclined plate portion extending from the second flat portion at a second inclination angle. These portions are arranged in the foregoing order. In this structure, the waving strips are arranged adjacent to each other in a transverse direction to each waving strip and are offset from each other in a longitudinal direction. Adjacent waving strips are connected at connecting portions between the first flat portions of the adjacent waving strips and between the second flat portions of the adjacent waving strips. A length (T) of each connecting portion in the longitudinal direction of each adjacent waving strip is less than or equal to about a thickness (t) of a plate forming each waving strip.

The length (T) represents a first distance between a first critical point between the second inclined plate portion and a first inner surface of the first flat portion of one of the waving strips and a second critical point between the first inner surface of the first flat portion and the first inclined plate portion of an adjacent one of the waving strips, and a second distance between a third critical point between the first inclined plate portion and a second inner surface of the second flat portion of one of the waving strips and a fourth critical point between the second inner surface of the second flat portion and the second inclined plate portion of an adjacent one of the waving strips.

A heat exchanger according to the present invention comprises a plurality of flat-type heat transfer tubes and an inner fin formed according to the above-described fin structure and provided in each heat transfer tube or an outer fin formed according to the above-described fin structure and provided at a position outside of each heat transfer tube. For example, an outer fin may be provided between adjacent heat transfer tubes. In either case, the inner or outer fin may be brazed to a heat transfer tube with a good brazing ability as described below. The heat exchanger may be formed as a multi-flow type heat exchanger comprising a pair of headers and the plurality of heat transfer tubes interconnecting the pair of headers.

A method for manufacturing a fin for a heat exchanger according to the present invention comprises a first step of forming an intermediate pre-formed plate by passing a flat plate material between a pair of first processing rollers, and a second step of forming a fin by passing the intermediate pre-formed plate between a pair of second processing rollers. In the first step, the intermediate preformed plate is formed, such that a plurality of zigzag strips each having a plurality of inclined plates connected successively in diagonal offset to each other and the zigzag strips are arranged adjacent to each other in a transverse direction to each zigzag strip and we offset by one-half pitch in a longitudinal direction, and adjacent zigzag strips are connected at a middle position of each inclined plate in a longitudinal direction of each inclined plate. In the second step, adjacent zigzag strips are bent at a portion connecting the adjacent zigzag strips, such that the fin comprises a plurality of waving strips, each having a repeated structure comprising a first flat portion, a first inclined plate portion extending from the first flat portion at a first inclination angle, a second flat portion extending from the first inclined plate portion in parallel to the first flat portion, and a second inclined plate portion extending from the second flat portion at a second inclination angle, formed in that order. The waving strips are arranged adjacent to each other in a transverse direction to each waving strip and are offset from each other in a longitudinal direction, such that adjacent waving strips are connected at connecting portions between the first flat portions of the adjacent waving strips and between the second flat portions of the adjacent waving strips, and a length (T) of each connecting portion in the longitudinal direction of each waving strip is less than or equal to about a thickness (t) of a plate forming each waving strip. Further, the definition of the length (T) is the same as that described above.

In the fin for a heat exchanger according to the present invention, a flow path structure for repeatedly diverging and rejoining the heat transfer medium is formed by arranging the waving strips adjacent to each other. By this flow path structure, a desired flow of the heat transfer medium, which has a lower temperature differential, may be achieved, and a high and uniformly efficient degree of heat transfer may be realized. Further, because the fin has a connecting structure in which the adjacent first flat portions in adjacent waving strips are partially and successively connected to each other and the adjacent second flat portions in adjacent waving strips are partially and successively connected to each other, a brazing material may readily flow without a discontinuous behavior at the portions connected to, for example, a heat transfer tube, thereby demonstrating superior brazing characteristics.

In such a fin structure, the length (T) of each connecting portion is less than or equal to about the thickness (t) of a plate forming each waving strip. Due to this relationship, bending by a rolling process may be possible at the connecting portions. Specifically, if the connection is made over a large area or a long length, as shown in JP' 484, such bending by a rolling process may be impossible. In the structure according to the present invention, however, the bending by a rolling process may be performed with no problem.

Particularly, in the method according to the present invention, in a first processing step, an intermediate preformed plate having zigzag strips arranged adjacent to each other is formed by passing a flat plate material between a pair of the first processing rollers. In a following second processing step, the connecting portions of the zigzag strips are successively bent to form a desired structure for a fin according to the present invention, in which the waving strips are connected to each other with the structure defined by the present invention. Therefore, the bending may be performed substantially continuously to form the fin from the flat plate material. By making such a rolling process possible, the processing of fins may be facilitated and the productivity of the fin manufacturing process may be greatly improved. Moreover, because generally the processing rollers may be manufactured in smaller sizes and less expensively than by a press die, the cost for manufacturing the fin may be significantly reduced.

Therefore, the heat exchanger using the fin according to the present invention may exhibit an excellent heat exchange ability and may be manufactured with a reduced cost.

Objects, features, and advantages of the present invention will be understood from the following detailed description of preferred embodiments of the present invention with reference to the accompanying figures.

BRIEF DESCRIPTION OF THE DRAWINGS

Embodiments of the invention are now described with reference to the accompanying figures, which are given by way of example only, and are not intended to limit the present invention.

DETAILED DESCRIPTION OF PREFERRED EMBODIMENTS

Figure 1:
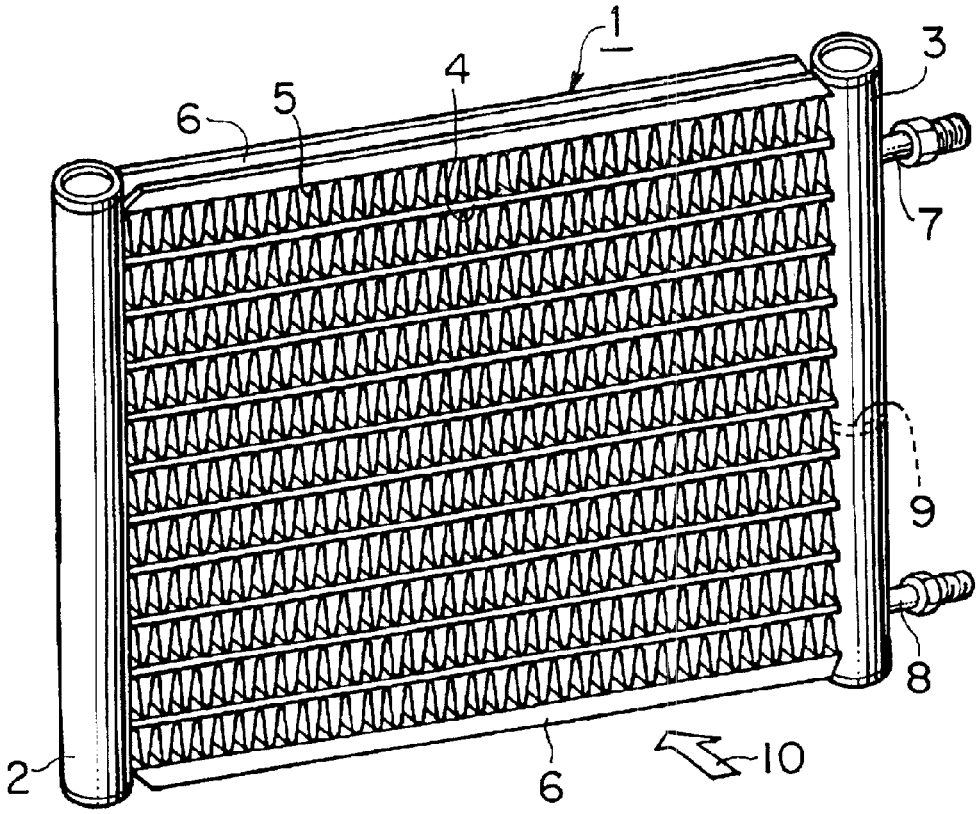
FIG. 1 is a perspective view of a heat exchanger according to an embodiment of the present invention.

Referring to FIGS. 1 to 5, a heat exchanger, for example, a condenser, such as a multi-flow type heat exchanger, according to an embodiment of the present invention is disclosed. In FIG. 1, heat exchanger 1 includes a pair of headers 2 and 3 disposed in parallel to each other. A plurality of heat transfer tubes 4 (for example, flat-type refrigerant tubes) are disposed in parallel to each other with a predetermined interval. Tubes 4 fluidly interconnect the pair of headers 2 and 3. Corrugated fins 5 are interposed between the respective adjacent heat transfer tubes 4 and outside of the outermost heat transfer tubes 4 as outermost fins. Side plates 6 are provided on outermost fins 5, respectively.

Inlet pipe 7 for introducing refrigerant into heat exchanger 1 through header 3 is provided on the upper portion of header 3. Outlet pipe 8 for removing refrigerant from heat exchanger 1 through header 3 is provided on the lower portion of header 3. The inside of header 3 is divided by partition 9. Refrigerant introduced through inlet pipe 7 into an upper chamber of header 3 defined by partition 9 is sent into header 2 through heat transfer tubes 4. The refrigerant then is sent into a lower chamber of header 3 defined by partition 9 through heat transfer tubes 4, and the refrigerant is discharged from the lower chamber of header 3 through outlet pipe 8. Arrow 10 shows an air flow direction.

Although inlet pipe 7, outlet pipe 8, and partition 9 are provided in one of headers 2 and 3 and a U-turn flow of refrigerant is formed, other flows may be formed. For example, one flow may be formed by providing only inlet pipe 7 to one header 3 without providing partition 9, and providing outlet pipe 8 to the other header 2.

Figure 2:
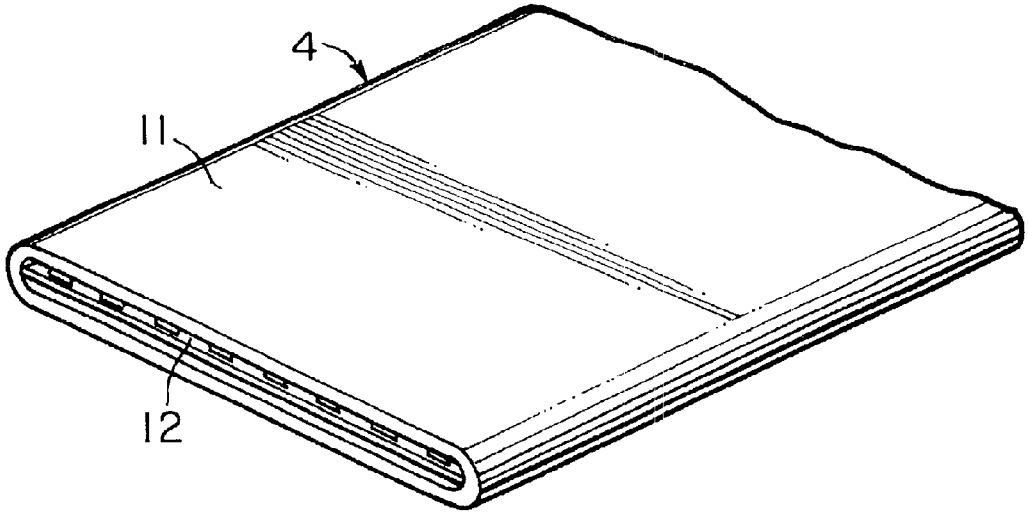
FIG. 2 is an enlarged, partial, perspective view of a heat transfer tube of the heat exchanger depicted in FIG. 1.
Figure 3:
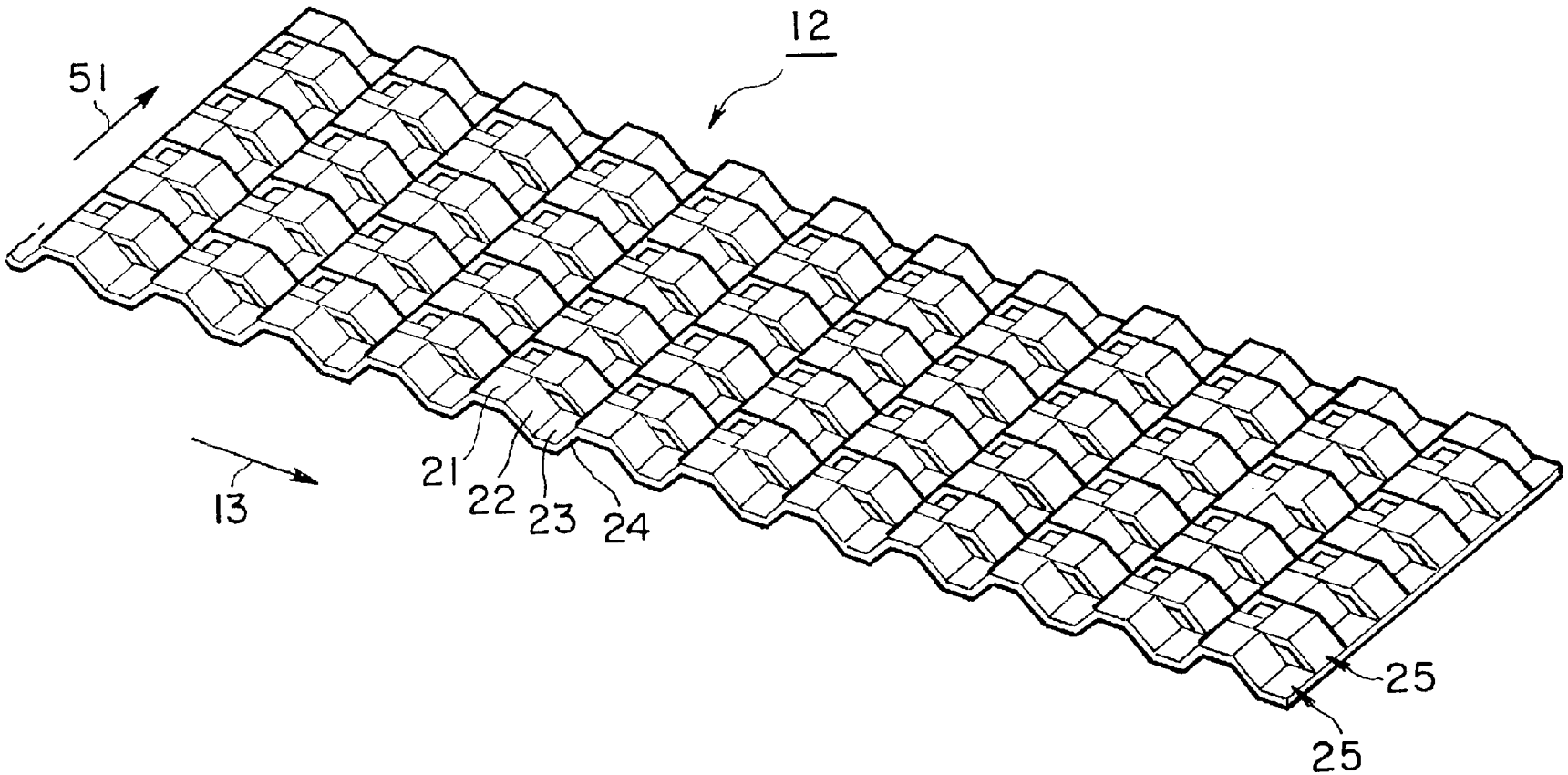
FIG. 3 is a partial, perspective view of an inner fin disposed in the heat transfer tube depicted in FIG. 2.
Figure 4:
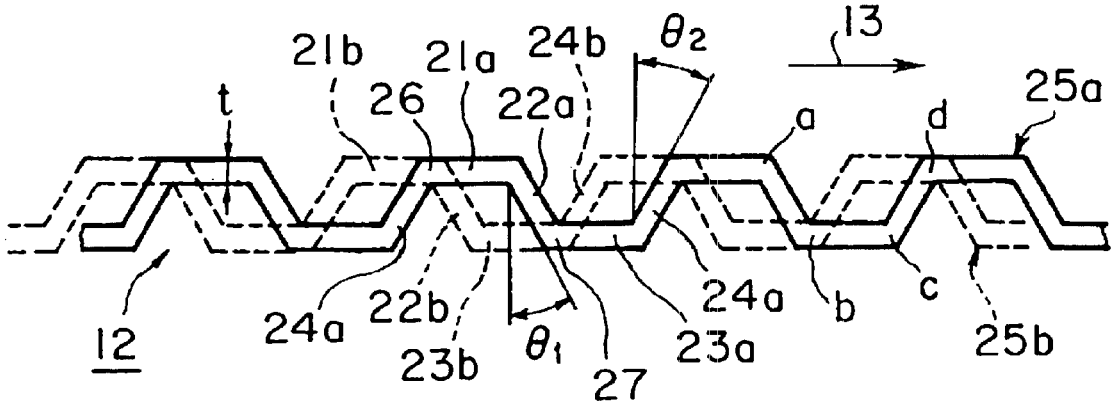
FIG. 4 is an enlarged, partial, side view of the inner fin depicted in FIG. 3.

Each heat transfer tube 4 of heat exchanger 1 may be constituted as depicted in FIGS. 2–5. In FIG. 2, heat transfer tube 4 comprises flat tube 11 and inner fin 12 which is inserted into tube 11. Inner fin 12 has paths which allow the heat exchange medium to flow substantially freely in the longitudinal and transverse directions of heat transfer tube 4, and in this embodiment, inner fin 12 is formed as depicted in FIGS. 3 and 4. In this embodiment depicted in FIGS. 3 and 4, the direction of arrow 13 identifies a flow direction of refrigerant and the longitudinal direction of tube 11.

Inner fin 12 has a plurality of waving strips 25 arranged adjacent to each other in a transverse direction of each waving strip 25. Each waving strip 25 has a repeated structure comprising first flat portion 21; first inclined plate portion 22 which extends from first flat portion 21 at first inclination angle $\theta_1$; second flat portion 23, which extends from first inclined plate portion 22 in parallel to first flat portion 21; and second inclined plate portion 24 which extends from second flat portion 23 at second inclination angle $\theta_2$, The portions are arranged in this order. Although first inclination angle $\theta_1$ is equal to second inclination angle $\theta_2$ in this embodiment, these angles may be different from each other. Waving strips 25 are arranged adjacent to each other (e.g., waving strips 25*a*, 25*b* in FIG. 4) and are positionally offset in the longitudinal direction from each adjacent waving strip. Adjacent waving strips 25 are connected only at connecting portions between first flat portions 21 (e.g., first flat portions 21*a*, 21*b* in FIG. 4) and between second flat portions 23 (e.g., second flat portions 23*a*, 23*b* in FIG. 4). Length (T) of each connecting portion 26 and 27 in the longitudinal direction of each waving strip is less than or equal to thickness (t) of a plate forming each waving strip.

Figure 5:
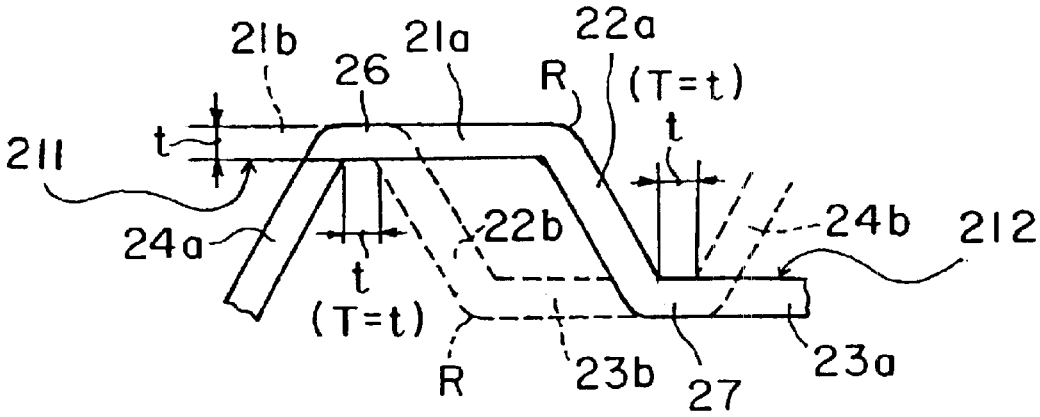
FIG. 5 is a schematic, partial, side view of a fin according to the present invention, showing an example of the relationship between T and t according to the present invention.

As depicted in FIG. 5, the above-described length (T) is defined as a first distance between a first critical point between second inclined plate portion 24*a* and between a first inner surface 211 of first flat portion 21*a* of one waving strip 25*a* and a second critical point between first inner surface 211 of first flat portion 21*b* and first inclined plate portion 22*b* of the other adjacent waving strip 25*b*, and a second distance between a third critical point between first inclined plate portion 22*a* and a second inner surface 212 of second flat portion 23*a* of one waving strip 25*a* and a fourth critical point between second inner surface 212 of second flat portion 23*b* and second inclined plate portion 24*b* of the other adjacent waving strip 25*b*. FIG. 5 depicts a case that the length (T) is equal to the thickness (t). In the structure depicted in FIG. 5, an arbitrary bend (R) is provided to the respective corners of first flat portions 21*a* and 21*b* and second flat portions 23*a*, 23*b*.

Figure 6:
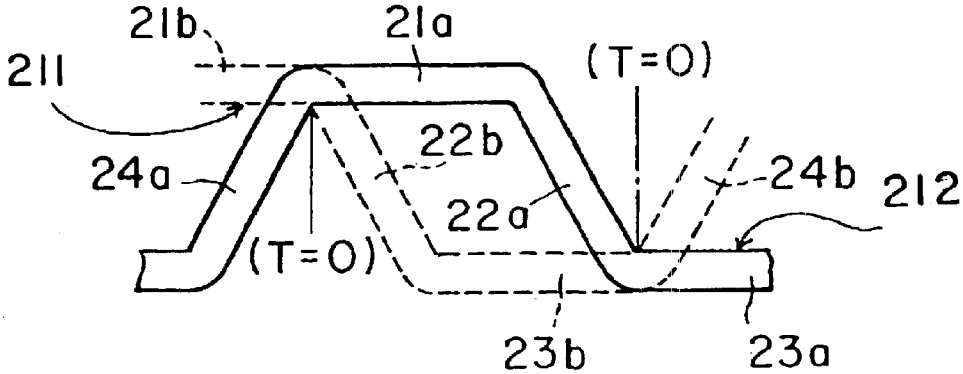
FIG. 6 is a schematic, partial, side view of a fin according to the present invention, showing an example of a lower limit of T according to the present invention.

Because the above-described length (T) is less than or equal to the plate thickness (t) of waving strip 25, regarding the connecting portions between first flat portions 21 and between second flat portions 23, the lower limit of the length (T) inevitably approaches zero. Specifically, as depicted in FIG. 6, when length (T) approaches its minimum value (e.g., zero), a first critical point between second inclined plate portion 24*a* and a first inner surface 211 of first flat portion 21*a* of one waving strip 25*a* and a second critical point between first inner surface 211 of first flat portion 21*b* and first inclined plate portion 22*b* of the other adjacent waving strip 25*b* are positioned at a substantially identical position in the longitudinal direction of the waving strips, and a third critical point between first inclined plate portion 22*a* and a second inner surface 212 of second flat portion 23*a* of one waving strip 25*a* and a fourth critical point between second inner surface 212 of second flat portion 23*b* and second inclined plate portion 24*b* of the other adjacent waving strip 25*b* are positioned at a substantially identical position in the longitudinal direction of the waving strips.

Figure 7:
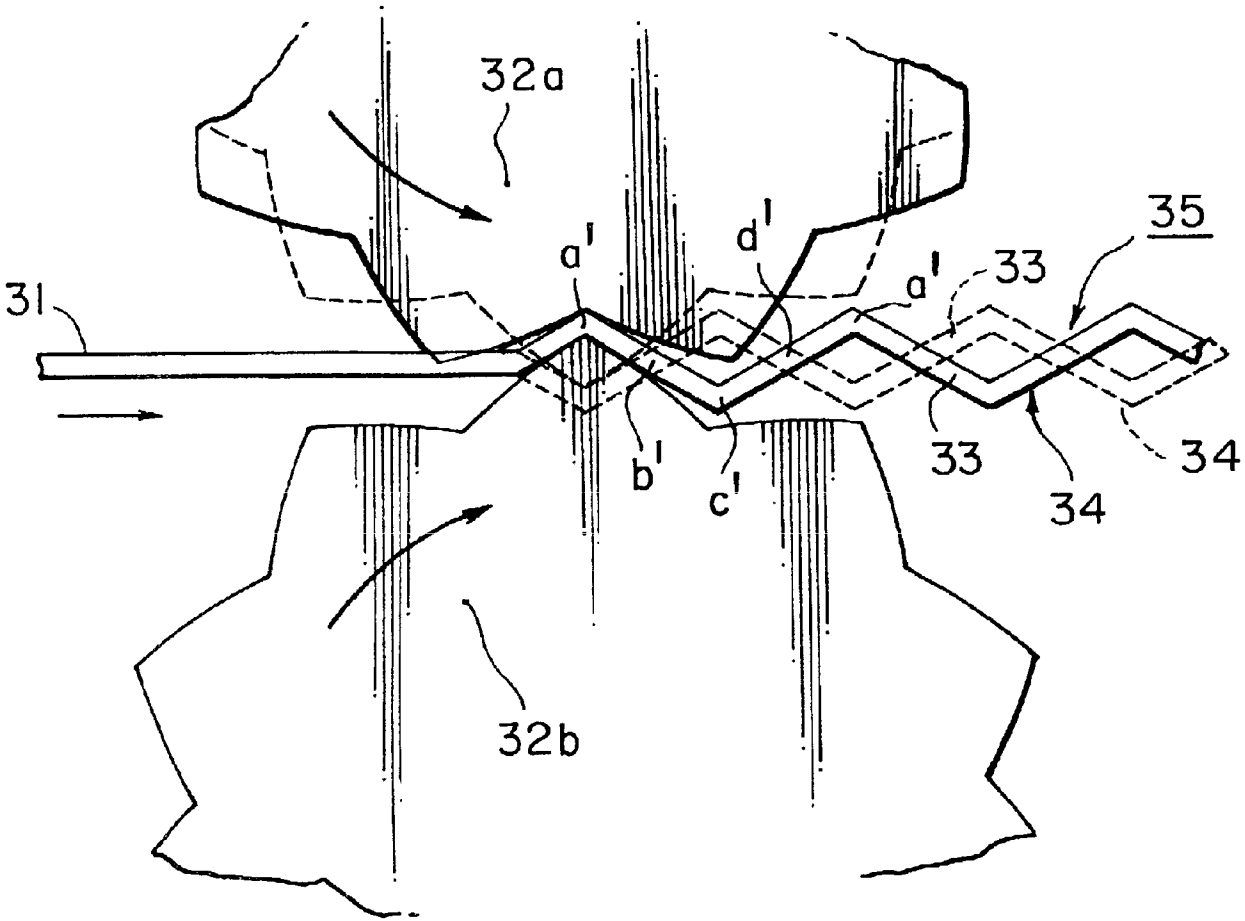
FIG. 7 is a schematic, partial, side view of first processing rollers used in a method for manufacturing a fin for a heat exchanger according to an embodiment of the present invention.
Figure 8:
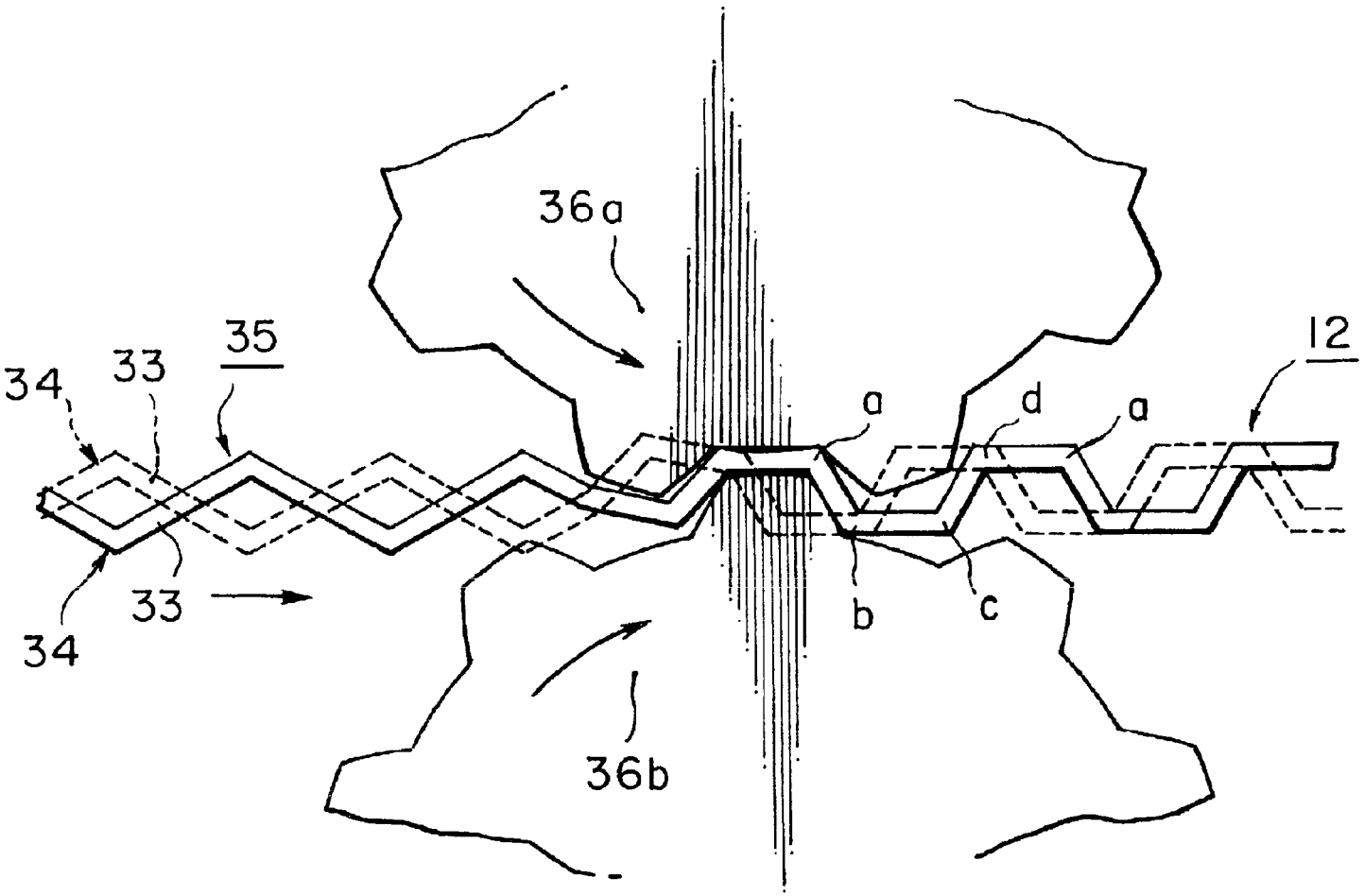
FIG. 8 is a schematic, partial, side view of second processing rollers used in a step following the step depicted in FIG. 7.

The above-described inner fin 12 is manufactured by the method according to the present invention, for example, by the rolling process, as depicted in FIGS. 7 and 8.

As depicted in FIG. 7, first, flat plate material 31 is continuously supplied as a raw material in the first rolling process. Flat plate material 31 is passed in the direction of the arrow between a pair of first processing rollers 32*a* and 32*b*, each having a predetermined zigzag pattern on its periphery, which are rotated in the directions of the arrows. By this rolling process, intermediate pre-formed plate 35 is formed, such that a plurality of zigzag strips 34, each extending in the plate running direction and each having a plurality of inclined plates 33 connected successively in diagonal offset to each other and such that zigzag strips 34 are arranged adjacent to each other in a transverse direction to each zigzag strip 34 and are offset by one-half pitch of one inclined plates 33 in a longitudinal direction to each zigzag strip 34. Moreover, adjacent zigzag strips 34 are connected at a middle position of each inclined plate 33 in a longitudinal direction of each inclined plate 33. In this intermediate pre-formed plate 35, positions a', b', c', and d' indicated in FIG. 7 correspond to positions a, b, c and d indicated in FIG. 4, respectively.

Successively, as depicted in FIG. 8, the second rolling process is applied to intermediate pre-formed plate 35. In the second rolling process, continuously supplied, intermediate pre-formed plate 35 is passed in the direction of the arrow between a pair of second processing rollers 36*a* and 36*b*, each having a predetermined zigzag pattern on its periphery, which are rotated in the directions of the arrows. The connecting portions of adjacent zigzag strips 34 (e.g., portions at positions a' and c' in FIG. 7) are bent between second processing rollers 36*a* and 36*b*. By this bending, fin 12 attains the form shown in FIG. 4 and is continuously manufactured. Positions a, b, c, and d in FIG. 8 indicate the same positions as positions a, b, c, and d in FIG. 4, respectively.

The process of bending by the rollers, depicted in FIGS. 7 and 8 is possible because the connecting length (T) is less than or equal to the plate thickness (t). In a condition, in which the connecting length (T) is greater than the plate thickness (t), even if the plate is forcibly bent, deformation or strain occurs. Consequently, the fin being formed may not achieve a desired shape. Therefore, in the present invention, the connecting length (T) must be less than or equal to the plate thickness (t) in order for the rolling process to be employed.

The waving pattern of a fin satisfying the above-described condition may be configured, for example, as shown in FIGS. 9–12.

Figure 9:
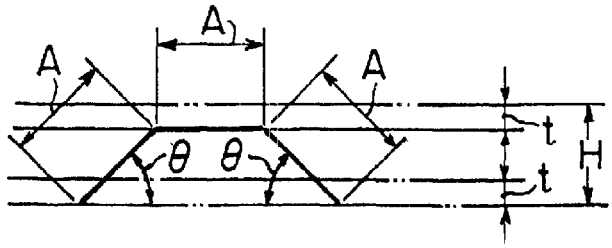
FIG. 9 is an explanatory diagram showing an example for designing a fin according to the present invention.

First, as depicted in FIG. 9, the inside form of a waving strip is designed with a height H reduced by a plate thickness (t). It is preferred to set the lengths of the respective sides of the raised portion and the depressed portion (e.g., the flat portions and the inclined plate portions) at the same length A. The length A and the inclination angle θ may be arbitrarily selected. The height H of the raised portion may be inevitably determined by the selection of length A and angle θ.

Figure 10:
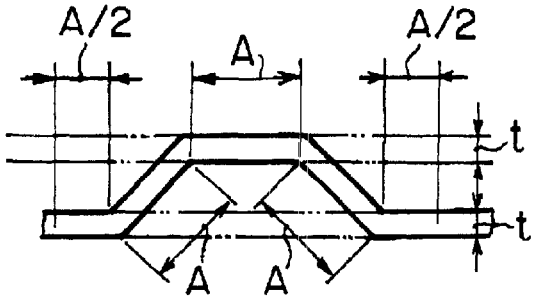
FIG. 10 is an explanatory diagram showing a design step following the step depicted in FIG. 9.

Next, as depicted in FIG. 10, a line parallel to the inside form determined in FIG. 9 is added with a separation corresponding to a plate thickness (t). By this, a basic form of a single raised portion or a single depressed portion may be determined.

Figure 11:
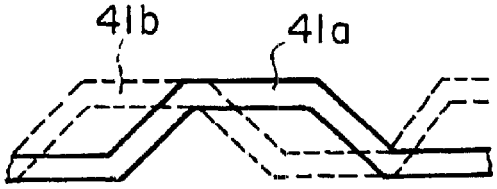
FIG. 11 is an explanatory diagram showing a design step following the step depicted in FIG. 10.
Figure 12:
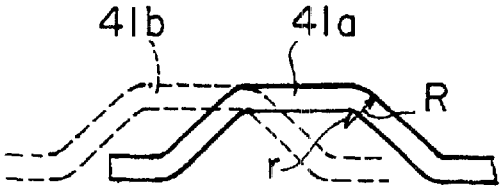
FIG. 12 is an explanatory diagram showing a design step following the step depicted in FIG. 11.
Figure 13:
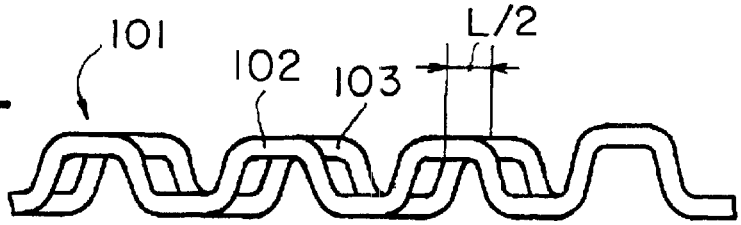
FIG. 13 PRIOR ART
FIG. 13 is a partial side view of a conventional fin.

Then, as depicted in FIG. 11, a waving strip 41*a* described above is offset to satisfy the aforementioned relationship between T and t to achieve an adjacent waving strip 41*b*. Further, as depicted in FIG. 12, desired forms for waving strips 41*a* and 41*b* may be attained by adding arbitrary bends R and r to the respective corners.

In heat transfer tube 4 having inner fin 12 thus manufactured, a heat transfer medium flowing in the longitudinal direction in tube 11 is distributed in right and left directions at each raised portion, particularly, and at the respective inclined plate portions. The flow repeatedly diverges and rejoins. After diverging, the heat transfer medium flows freely into the surface and back surface sides through the respective communication holes formed by the offset waving strips. The diverged flows then rejoin, and the heat transfer medium continues to flow in tube 11 while such operations are repeated. Therefore, the heat transfer medium flows in tube 11 while being substantially and continuously mixed, and the heat transfer medium may be mixed more uniformly in the transverse direction of tube 11, namely, in the direction in which air passes. As a result, heat transfer in the transverse direction of tube 11 may be performed more uniformly, and the heat exchange performance of tube 11 may be more uniform. Moreover, the heat exchange performance of the whole of heat transfer tubes 4, and ultimately, of the whole of heat exchanger 1, may increase.

Referring again to FIG. 3, although the direction shown by arrow 13 is chosen as the heat transfer medium flow direction and the longitudinal direction of tube 11, a direction shown by arrow 51 may be chosen as the heat transfer medium flow direction and the longitudinal direction of tube 11. Moreover, in this configuration, because the raised portions and the depressed portions of the waving strips are alternate in the heat transfer medium flow direction, and because the heat transfer medium is mixed uniformly, superior heat exchange performance may be achieved similarly to that described in the above-described embodiment.

Inner fin 12, which exhibits such superior performance, may be manufactured, for example, from an aluminum alloy, and it may be brazed in tube 11, which is similarly manufactured from an aluminum alloy. For example, by cladding a brazing material onto either inner fin 12 or the inner surface of tube 11, the brazing material may flow well when heated, thereby efficiently achieving a desired brazing. In inner fin 12, because first flat portions 21 and second flat portions 23 of adjacent waving strips 25 are connected to each other, the brazing material may flow continuously along the connecting portions, thereby achieving superior brazing ability.

Although the connecting portions of waving strips achieving superior brazing characteristics may be formed by pressing, when processed by pressing, the productivity is extremely low, and the cost for manufacture is high. On the contrary, however, in the present invention, because the connecting portions may be formed by roll bending, the processing may be readily performed with productivity and a reduction of manufacturing cost.

Although the fin according to the present invention is used as an inner fin disposed in a flat tube in the aforementioned embodiment, the fin may be used as an outer fin disposed outside the heat transfer tube, for example, as a fin provided instead of corrugated fin 5 depicted in FIG. 1. Of course, in such an outer fin, as long as the fin has a form specified by the present invention, it may be manufactured readily and at reduced cost by methods according to the present invention.

Although several embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is to be determined by the claims which follow.

What is claimed is:

1. A fin for a heat exchanger comprising a plurality of waving strips, each having a repeated structure comprising a first flat portion, a first inclined plate portion extending from said first flat portion at a first inclination angle, a second flat portion extending from said first inclined plate portion in parallel to said first flat portion, and a second inclined plate portion extending from said second flat portion at a second inclination angle, arranged in this order, wherein said waving strips are arranged adjacent to each other in a transverse direction to each waving strip and are offset from each other in a longitudinal direction, such that said adjacent waving strips are connected physically only at connecting portions between said first flat portions of said adjacent waving strips and between said second flat portions of said adjacent waving strips, and a length (T) of an outer surface and an inner surface of each connecting portion in said longitudinal direction of each waving strip is less than or equal to about a thickness (t) of a plate forming each waving strip.

2. The fin of claim 1, where said length (T) is a first distance between a first critical point between said second inclined plate portion and said first inner surface of said first flat portion of one of said waving strips and a second critical point between said first inner surface of said first flat portion and said first inclined plate portion of an adjacent one of said waving strips, and a second distance between a third critical point between said first inclined plate portion and said second inner surface of said second flat portion of one of said waving strips and a fourth critical point between said second inner surface of said second flat portion and said second inclined plate portion of an adjacent one of said waving strips.

3. A heat exchanger comprising:

a plurality of flat-type heat transfer tubes and an inner fin provided in each heat transfer tube, said inner fin comprising a plurality of waving strips, each having a repeated structure comprising a first flat portion, a first inclined plate portion extending from said first flat portion at a first inclination angle, a second flat portion extending from said first inclined plate portion in parallel to said first flat portion, and a second inclined plate portion extending from said second flat portion at a second inclination angle, arranged in this order, wherein said waving strips are arranged adjacent to each other in a transverse direction to each waving strip and are offset from each other in a longitudinal direction, such that said adjacent waving strips are connected physically only at connecting portions between said first flat portions of said adjacent waving strips and between said second flat portions of said adjacent waving strips, and a length (T) of an outer surface and an inner surface of each connecting portion in said longitudinal direction of each waving strip is less than or equal to about a thickness (t) of a plate forming each waving strip.

4. The heat exchanger of claim 3, where said length (T) represents a first distance between a first critical point between said second inclined plate portion and said first inner surface of said first flat portion of one of said waving strips and a second critical point between said first inner surface of said first flat portion and said first inclined plate portion of an adjacent one of said waving strips, and a second distance between a third critical point between said first inclined plate portion and said second inner surface of said second flat portion of one of said waving strips and a fourth critical point between said second inner surface of said second flat portion and said second inclined plate portion of an adjacent one of said waving strips.

5. The heat exchanger of claim 3, wherein said inner fin is brazed to an inner surface of said heat transfer tube.

6. The heat exchanger of claim 3, wherein said heat exchanger is formed as a multi-flow type heat exchanger comprising a pair of headers, and said plurality of heat transfer tubes interconnecting said pair of headers.

7. A heat exchanger comprising:

a plurality of flat type heat transfer tubes and an outer fin provided at a position outside of each heat transfer tube, said outer fin comprising a plurality of waving strips, each having a repeated structure comprising a first flat portion, a first inclined plate portion extending from said first flat portion at a first inclination angle, a second flat portion extending from said first inclined plate portion in parallel to said first flat portion, and a second inclined plate portion extending from said second flat portion at a second inclination angle, arranged in this order, wherein said waving strips are arranged adjacent to each other in a transverse direction to each waving strip and are offset from each other in a longitudinal direction, such that said adjacent, waving strips are connected physically only at connecting portions between said first flat portions of said adjacent waving strips and between said second flat portions of said adjacent waving strips, and a length (T) of an outer surface and an inner surface of each connecting portion in said longitudinal direction of each waving strip is less than or equal to about a thickness (t) of a plate forming each waving strip.

8. The heat exchanger of claim 7, wherein said length (T) represents a first distance between a first critical point between said second inclined plate portion and said first inner surface of said first flat portion of one of said waving strips and a second critical point between said first inner surface of said first flat portion and said first inclined plate portion of an adjacent one of said waving strips, and a second distance between a third critical point between said first inclined plate portion and said second inner surface of said second flat portion of one of said waving strips and a fourth critical point between said second inner surface of said second flat portion and said second inclined plate portion of an adjacent one of said waving strips.

9. The heat exchanger of claim 7, wherein said outer fin is brazed to each adjacent heat transfer tube.

10. The heat exchanger of claim 7, wherein said heat exchanger is formed as a multi-flow type heat exchanger comprising a pair of headers, and said plurality of heat transfer tubes interconnecting said pair of headers.

* * * * *